US008070575B2

(12) United States Patent
Mruk

(10) Patent No.: US 8,070,575 B2
(45) Date of Patent: Dec. 6, 2011

(54) BOWL N HOLD-EM

(75) Inventor: James C Mruk, Henderson, NV (US)

(73) Assignee: Jam-N Enterprises, Inc., Henderson, NV (US)

( * ) Notice: Subject to any disclaimer, the term of this patent is extended or adjusted under 35 U.S.C. 154(b) by 964 days.

(21) Appl. No.: 11/866,409

(22) Filed: Oct. 2, 2007

(65) Prior Publication Data

US 2009/0088264 A1 Apr. 2, 2009

(51) Int. Cl.
*A63F 1/00* (2006.01)
*A63D 3/00* (2006.01)
*A63F 9/24* (2006.01)

(52) U.S. Cl. ..... 463/13; 473/54; 434/249

(58) Field of Classification Search ..... 463/13; 473/54; 434/249
See application file for complete search history.

(56) References Cited

U.S. PATENT DOCUMENTS 4,597,575 A 7/1986 Kosof
4,787,633 A 11/1988 Fritzemeier
4,817,947 A 4/1989 Gautraud
5,899,815 A * 5/1999 Helou et al. ..... 473/54
6,270,411 B1 * 8/2001 Gura et al. ..... 463/20
6,464,595 B2 * 10/2002 Tsujita ..... 473/70
2003/0087707 A1 * 5/2003 Lavoie et al. ..... 473/54
2008/0171607 A1 * 7/2008 Minard et al. ..... 473/54
2010/0134687 A1 * 6/2010 Vaioli ..... 348/578
2010/0227658 A1 * 9/2010 Crowder et al. ..... 463/1

OTHER PUBLICATIONS

STIC Search.*

* cited by examiner

*Primary Examiner* — Dmitry Suhol
*Assistant Examiner* — Malina K Rustemeyer
(74) *Attorney, Agent, or Firm* — Michael Artemis

(57) ABSTRACT

The game will be called Bowl N Hold-em. It will combine the standard game of bowling, along with the poker game Texas Hold-em. The game will utilize the bowling center's computer scoring system, along with a standard deck of playing cards. This will be done by creating a computer program that will be compatible with a bowling center's existing computer software. The maximum number of players per pair of lanes, shall be ten. One standard deck of playing cards shall be used per pair of lanes.

32 Claims, 2 Drawing Sheets

| | Frame 1 | Frame 2 | Frame 3 | Frame 4 | Frame 5 | Frame 6 | Frame 7 | Frame 8 | Frame 9 | Frame 10 |
|---|---|---|---|---|---|---|---|---|---|---|
| Player 1 | 9 / | 9 / | X | X | X | 9 / | 9 / | X | 9 / | |
| | 19 | 39 | 69 | 98 | 118 | 137 | 157 | 177 | 197 | |

| | Frame 1 | Frame 2 | Frame 3 | Frame 4 | Frame 5 | Frame 6 | Frame 7 | Frame 8 | Frame 9 | Frame 10 |
|---|---|---|---|---|---|---|---|---|---|---|
| Player 1 | 9 / | 9 / | X | X | X | 9 / | 9 / | X | 9 / | X X X |
| | 19 | 39 | 69 | 98 | 118 | 137 | 157 | 177 | 197 | 227 |

BOWL N HOLD-EM

FIELD OF THE INVENTION

This invention relates to the sport of bowling and the poker game Texas Hold-em and, particularly, to a computerized method which combines these two games.

BACKGROUND OF THE INVENTION

Bowling is a popular sport that has been around for centuries. It is one of the oldest most widely played games in the world. The sport of bowling is played recreationally and in organized leagues and competitions by millions of people, every age, any gender. Since its' creation, which can be traced back to the stone age, the game has evolved from a crude form of the sport, to the conventional game of bowling that is played today. Over the years, there have been many variations to the game to continually challenge a player and increase the public's interest in the sport. The most significant technological advancement in the game of bowling was the introduction of the automatic pinspotter in the 1940's. This machine revolutionized the bowling industry and brought it into the modern era. It is now time to once again, revolutionize the bowling industry by introducing a new method of playing this popular sport. What better way then to combine one of the most widely played games in the world, with the most popular form of poker played in the United States today.

SUMMARY

According to the invention, the conventional game of bowling will be played. The variation to this game occurs when the poker game Texas Hold-em is incorporated into the bowling center's computerized scoring system. This will be done by creation of a computer program that is compatible with the existing computer software used for a bowling center's scoring system. There will be a maximum of ten players, per pair of lanes. Each player will have the opportunity at the beginning of the game to select whether or not they would like to participate in the Texas Hold-em aspect of the bowling game. Only players that have selected to participate in the poker aspect of the game, will receive cards that are drawn at random by the computer. A conventional game of bowling consists of ten frames. The computer will randomly draw cards as each player completes specific frames.

Once a participating bowler's name is entered into the scoring system, two "hole" cards will be drawn at random, by the computer. "Hole" cards are for each player's individual poker hand, which will be combined later in the game with community cards and used to complete their final poker hand. The conventional bowling aspect of the game now begins. Each bowling frame is considered "filled" when a bowler makes a strike, or attempts a second shot to pick up the spare.

After "filling" the first frame, a card is drawn at random by the computer. The card drawn is known as one of the "flop" cards. This is a community card and will be used by all players to complete their own individual hand, in which the best five cards are played.

After "filling" the second frame, no card will be drawn.

After "filling" the third frame, a card is drawn at random by the computer. The card drawn is known as one of the "flop" cards. This is a community card and will be used by all players to complete their own individual hand, in which the best five cards are played.

After "filling" the fourth frame, no card will be drawn.

After "filling" the fifth frame, a card is drawn at random by the computer. The card drawn is known as one of the "flop" cards. This is a community card and will be used by all players to complete their own individual hand, in which the best five cards are played.

After "filling" the sixth frame, no card will be drawn.

After "filling" the seventh frame, a card is drawn at random by the computer. The card drawn is known as the "turn" card. This is a community card and will be used by all players to complete their own individual hand, in which the best five cards are played.

After "filling" the eighth frame, no card will be drawn.

After "filling" the ninth frame, a card is drawn at random by the computer. The card drawn is known as the "river" card. This is a community card and will be used by all players to complete their own individual hand, in which the best five cards are played.

After all participating players have filled their ninth frame, each player will now have two "hole" cards and there will be five community cards at the top of the computerized scoring screen. A player's final poker hand will consist of their two "hole" cards and three community cards to complete their best poker hand.

The tenth and final frame will be a bonus frame. The bonus has been added to give the game a twist and provide players with an opportunity to improve their poker hand. This method will add excitement and provide challenge and incentive to all participating players. If a player's poker hand can be improved and a player fills the tenth frame with three consecutive strikes, otherwise known as striking out (XXX), the computer will remove one of their "hole" cards and replace it with the best available card in the deck to improve their hand.

After all players have filled the tenth and final frame and any bonus cards have been drawn by the computer, each participating player will have a final poker hand and all players will have a conventional bowling score.

BRIEF DESCRIPTION OF THE DRAWINGS

The features of this invention are shown in detail with the accompanying drawing. This drawing simulates the appearance of the standard computerized scoring screen currently utilized by bowling centers and incorporates the poker game Texas Hold-em, as described in the claims. This drawing represents a hypothetical game, played by one player who has chosen to participate in the poker aspect of the game. The method reflected in this drawing first represents the player having filled nine frames and the computer having randomly drawn the player's "hole" cards and all community cards; the player then fills the tenth and final bonus frame by striking out, wherein the computer removes one of their "hole" cards and replaces it with the best available card in the deck to improve the player's final poker hand.

As illustrated in FIG. 2, the player's "hole" cards initially consisted of an Ace of Spades and a Two of Clubs. After the player filled the bonus frame with three consecutive strikes in a row, the computer improved their poker hand by removing the Two of Clubs and replacing it with an Ace of Diamonds.

DETAILED DESCRIPTION OF THE PREFERRED EMBODIMENT

Figures 1, 2, 3, 4, 5, 6, 7:
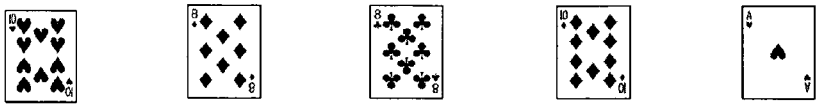
FIG. 1 represents a computerized scoring sheet for a hypothetical conventional bowling game played by one player in accordance to the method of the present invention, wherein the player has filled nine frames and the computer has drawn at random the player's "hole" cards and all the community cards required to complete the poker aspect of the game.
FIG. 2 illustrates the player's two individual "hole" cards which are drawn at random by the computer, once a player's name is entered into the scoring system.
FIG. 3 illustrates the first of three "flop" cards that is drawn at random by the computer, after the first frame has been filled. This is a community card and will be played by all players to complete their final poker hand.
FIG. 4 illustrates the second of three "flop" cards that is drawn at random by the computer, after the third frame has been filled. This is a community card and will be played by all players to complete their final poker hand.
FIG. 5 illustrates the third of three "flop" cards that is drawn at random by the computer, after the fifth frame has been filled. This is a community card and will be played by all players to complete their final poker hand.
FIG. 6 illustrates the "turn" card that is drawn at random by the computer, after the seventh frame has been filled. This is a community card and will be played by all players to complete their final poker hand.
FIG. 7 illustrates the "river" card that is drawn at random by the computer, after the ninth frame has been filled. This is a community card and will be played by all players to complete their final poker hand.
Figures 8, 9:
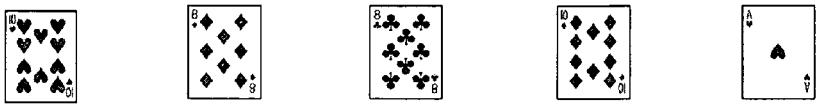
FIG. 8 represents a computerized scoring sheet for a hypothetical conventional bowling game played by one player in accordance to the method of the present invention, wherein the player has filled the tenth and final bonus frame with three consecutive strikes in a row. Since player one struck out in the bonus frame, the computer has awarded them with the best card available in the deck to improve their final poker hand. In this example, it is the Ace of Diamonds. The player has a conventional bowling score of 227 and their improved poker hand consists of a full house, Three Aces and Two Tens.
FIG. 9 illustrates the change in the player's individual "hole" cards once they struck out in the tenth frame.

The method of playing a conventional bowling game and combining it with the poker game Texas Hold-em, as described in the invention, is designed to increase the level of excitement and interest by adding a degree of chance to the already popular sport of bowling.

The preferred embodiment, is a game intended to be played with a maximum number of ten players, per each pair of lanes. The computer will utilize one standard deck of playing cards per each pair of lanes. Although the preferred embodiment of this invention described herein as a game for multiple players, or teams, the present invention can be appreciated by individual players.

The preferred embodiment of this method of playing a game is intended for those already skilled in the art and those familiar with the rules of the poker game Texas Hold-em. Of course, this method is not limited to such specific schemes.

The preferred embodiment of this method of playing a game is intended to allow bowling centers, leagues, or other organized groups to have the opportunity in awarding a variety of prizes for winning ranked poker hands, in addition to the numerous awards and prizes that are already distributed to skilled bowlers. The method of playing this invention is not intended to include a betting strategy, wherein players are betting against each other.

In the preferred embodiment of the invention, a bowler first begins by entering his name into the computerized scoring system. A bowler will then have the opportunity to select whether or not they want to participate in the poker aspect of the game, or if they would prefer to only bowl a conventional bowling game. This method is intended to allow all bowlers an opportunity to bowl on the same lane as individuals who will participate in the poker aspect of the game. Utilizing this selection process will allow league bowlers, or families and friends, from having to split their team and bowl on separate lanes. After a player's selection has been completed, the computer will randomly draw the first two individual player's cards wherein known as "hole" cards. This method will continue until all bowlers have been entered into the scoring system and those participating in the poker aspect of the game, have received their "hole' cards.

Next in the preferred embodiment of the invention, the first bowler will begin to bowl. As in the conventional game of bowling, a frame is considered "filled" when a bowler makes a strike, or attempts a second shot to pick up the spare. In this method of the game, after every player participating in the poker aspect of the game has filled the first, third and fifth frames, the computer will randomly draw a card after each of these frames wherein these cards will be known as "flop" cards. These cards are community cards and will be utilized by all participating players at the end of the game to complete their poker hand.

In the preferred embodiment of the invention, in this method of the game after every player participating in the poker aspect of the game has filled the seventh frame, the computer will randomly draw a card wherein this card will be known as the "turn" card. This card is a community card and will be utilized by all participating players at the end of the game to complete their poker hand.

In the preferred embodiment of the invention, in this method of the game after every player participating in the poker aspect of the game has filled the ninth frame, the computer will randomly draw a card wherein this card will be known as the "river" card. This card is a community card and will be utilized by all participating players at the end of the game to complete their poker hand.

In this method of the game, there will be no cards drawn at random by the computer after the second, fourth, sixth and eighth frames have been filled.

To accurately play the poker game of Texas Hold-em, there are a set number of cards that must be dealt to each player and a set number of cards that are community cards and used by all players to complete their individual poker hands. In the preferred embodiment of the invention, the intention is to have the computer draw cards at random after specific frames, to allow for the poker aspect of the game to continue throughout the entire game of bowling, leaving the tenth frame open as a bonus frame.

Last, in the preferred embodiment, this method is intended to give the skilled bowler, or the lucky bowler, an opportunity to possibly improve their poker hand, by adding a bonus after the tenth frame. If a player should fill the tenth and final frame with three consecutive strikes, otherwise known as striking out (XXX), and their final poker hand can be improved by a card that is still available in the deck, the computer will replace one of their "hole" cards to improve their final poker hand.

After all players have filled the tenth and final frame and any bonus cards have been drawn, the game is over. Each player will now have a bowling score and all players participating in the poker aspect of the game will have a final poker hand.

Although the present invention has been described in considerable detail with reference to certain preferred visions thereof, other versions are possible. Therefore, the spirit and scope of the appended claims should not be limited to the descriptions of the preferred version contained therein. The present examples and embodiments, therefore, are to be considered in all respects as illustrative and not restrictive, and the invention is not to be limited to the details given herein.

What is claimed is:

1. A method of playing a conventional game of bowling in combination with a poker card game of Texas Hold-em, the method comprising the steps of: (a) each player bowling according to the conventional game of bowling; (b) a computer having a processor programmed to randomly draw for each player two cards, known as "hole" cards, before the conventional game of bowling begins, wherein the two "hole" cards are combined with a plurality of community cards to form an individual poker hand for each player in which a best five cards are played; (c) the computer processor further programmed to randomly draw community cards after specific bowling frames are filled; (d) cards randomly drawn by the computer will be according to the rules of the poker game Texas Hold-em; (e) each player will have an opportunity to improve their poker hand in the tenth frame by bowling three strikes in a row.

2. The method of claim 1 prepared by the steps of entering a bowler's name into the scoring system.

3. The method of claim 1 wherein the conventional bowling aspect of the game begins, starting with frame one.

4. The method of claim 3 wherein a frame is "filled" when a bowler makes a strike, or attempts a second shot to pick up a spare.

5. The method of claim 1 wherein after filling frame one, a first community card is drawn at random by the computer.

6. The method of claim 1 wherein after filling frame two, no card will be drawn by the computer.

7. The method of claim 1 wherein after filling frame three, a second community card will be drawn at random by the computer.

8. The method of claim 1 wherein after filling frame four, no card will be drawn by the computer.

9. The method of claim 1 wherein after filling frame five, a third community card will be drawn at random by the computer.

10. The method of claim 5 wherein the card drawn randomly by the computer after frame one, will be known as the first card of a "flop".

11. The method of claim 7 wherein the card drawn randomly by the computer after frame three, will be known as the second card of a "flop".

12. The method of claim 9 wherein the card drawn randomly by the computer after frame five, will be known as the third card of a "flop".

13. The method of claim 1 wherein after filling frame six, no card will be drawn by the computer.

14. The method of claim 1 wherein after filling frame seven, a fourth community card will be drawn at random by the computer.

15. The method of claim 14 wherein the card drawn randomly by the computer after frame seven, will be known as a "turn" card.

16. The method of claim 1 wherein after filling frame eight, no card will be draw by the computer.

17. The method of claim 1 wherein after filling frame nine, a fifth community card will be drawn at random by the computer.

18. The method of claim 17 wherein the card drawn randomly by the computer after frame nine, will be known as a "river" card.

19. The method of claim 5 wherein the card drawn randomly by the computer after frame one is filled, is considered a community card and is played by all players.

20. The method of claim 7 wherein the card drawn randomly by the computer after frame three is filled, is considered a community card and is played by all players.

21. The method of claim 9 wherein the card drawn randomly by the computer after frame five is filled, is considered a community card and is played by all players.

22. The method of claim 14 wherein the card drawn randomly by the computer after frame seven is filled, is considered a community card and is played by all players.

23. The method of claim 18 wherein the card drawn randomly by the computer after frame nine is filled, is considered a community card and is played by all players.

24. The method of claim 19 wherein a community card will be used by all players to complete their own individual hand, in which the best five cards are played.

25. The method of claim 20 wherein a community card will be used by all players to complete their own individual hand, in which the best five cards are played.

26. The method of claim 21 wherein a community card will be used by all players to complete their own individual hand, in which the best five cards are played.

27. The method of claim 22 wherein a community card will be used by all players to complete their own individual hand, in which the best five cards are played.

28. The method of claim 23 wherein a community card will be used by all players to complete their own individual hand, in which the best five cards are played.

29. The method of claim 1 wherein the standard rules of the poker game Texas Hold-em apply, said method comprising the steps of: (a) a player's poker hand including their two individual "hole" cards; (b) a player's poker hand including the five community cards; (c) a player's poker hand comprised of the best five cards of all seven cards.

30. The method of claim 1 wherein the tenth and final frame will be a bonus frame, said method further comprising the steps of: (f) a player filling the tenth frame with three consecutive strikes, otherwise known as striking out (XXX); (g) if a player's hand can be improved, the computer processor programmed to remove one of their hole cards; (h) if a hole card is removed, the computer processor programmed to replace it with the best available card in the deck to improve their hand.

31. The method of claim 1 wherein a standard scoring of the bowling game will be kept.

32. The method of claim 1 wherein upon completing a tenth frame, each player will have a poker hand, along with a standard bowling score.

* * * * *